United States Patent [19]

Stangel

[11] 3,986,286

[45] Oct. 19, 1976

[54] SHELL MAGAZINE AND FEEDER

[76] Inventor: Le Roy J. Stangel, P.O. Box 502, Oconomowoc, Wis. 53066

[22] Filed: Feb. 10, 1975

[21] Appl. No.: 548,866

[52] U.S. Cl. ..... 42/87; 89/35 R; 224/15

[51] Int. Cl.[2] ..... F41C 27/00

[58] Field of Search ..... 42/87, 88; 206/3; 224/5 MC, 13–15, 17, 18, 21, 22; 89/35 R, 33 BB, 33 C

[56] References Cited

UNITED STATES PATENTS

| | | | |
|---|---|---|---|
| 501,642 | 7/1893 | Barton | 224/15 |
| 3,219,244 | 11/1965 | Blask | 224/15 |
| 3,332,594 | 7/1967 | De Capua | 224/15 |
| 3,515,321 | 6/1970 | Webster | 42/87 |

*Primary Examiner*—Charles T. Jordan
*Attorney, Agent, or Firm*—Gerald P. Welch

[57] ABSTRACT

A shell dispenser and container for trap and skeet shooters including a plurality of tubular elements partially apertured to permit removal of a pair of shells under a similar aperture in the top of the container which permits the placement and storage of a load of shells through the same container aperture.

2 Claims, 5 Drawing Figures

SHELL MAGAZINE AND FEEDER

BRIEF SUMMARY OF THE INVENTION

The device is a rectangular container with rounded corners. At the top of one side is a downwardly disposed clip for supporting the container on the shooter's belt. At the other edge of the container top is an aperture of a size to facilitate the manual removal of two shells at a time, and a thumb movement of a projecting element forwardly thereof will push one or two more shells into position for gun loading.

The shells are loaded into a train of cylindrical elements, each having a top projection engaged within a notch in the cylinder immediately above. The notch is also a keeper for a lateral projection part of the aforementioned top projection, to provide for simultaneous movement of all the cylinders and the contained shells.

DETAILED DESCRIPTION

The device 10 has a top aperture at 11 extending into an end or lateral aperture at 12 for insertion or removal of the shells 13 into and out of the chain of partially cylindrical elements 14 which store and keep moving the elements 14 and the shells 13 contained therein by upward movement of the thumb of the shooter against projection 20.

Figure 5:
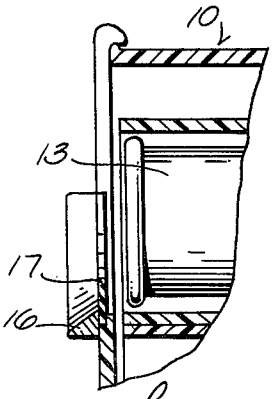
FIG. 5 is a fragmentary view of said container.

As shown in FIG. 5, a funnel 16 guides entry of the shells 13, and a rubber element 17 keeps the shells from outward movement from the elements 14 when the container 10 might be tilted.

Figure 1:
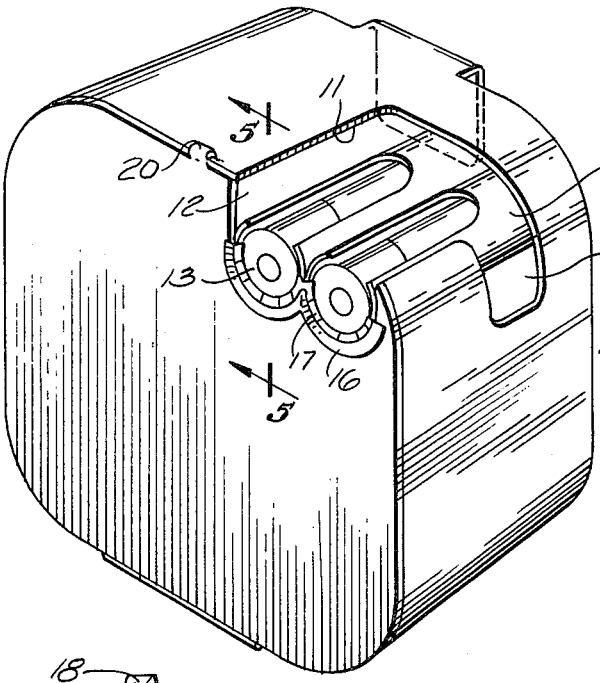
FIG. 1 is a perspective view from above of the container showing the top and side aperture therein to facilitate quick removal therefrom of one or two shells.
Figure 3:
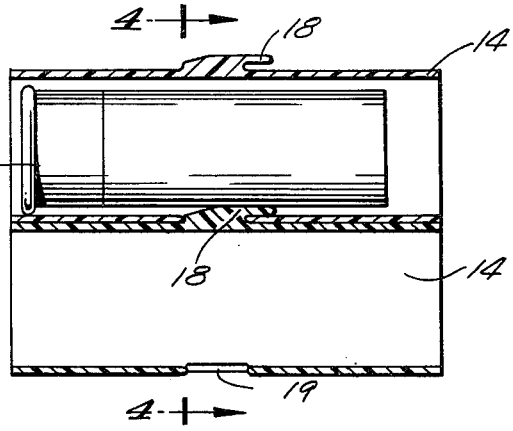
FIG. 3 is a view partly in section and partly in elevation of the shell carriers.
Figure 4:
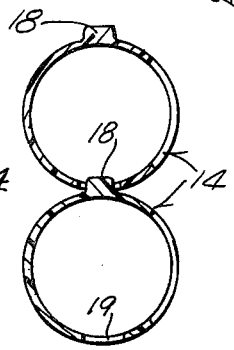
FIG. 4 is a cross-sectional view taken on line 4—4 of FIG. 3.
Figure 2:
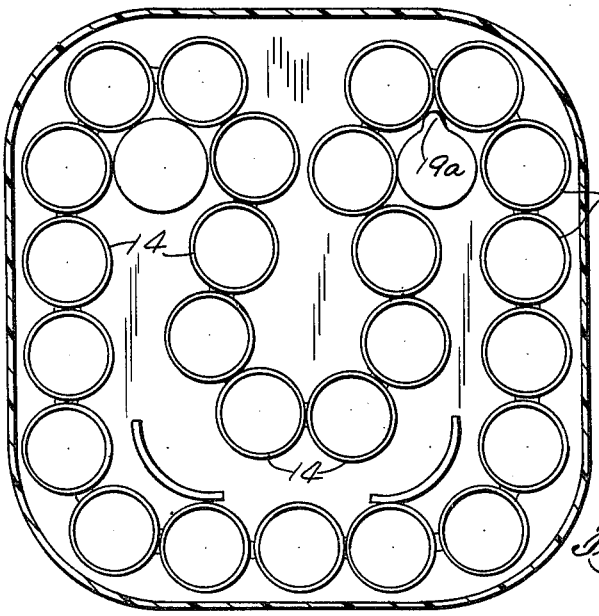
FIG. 2 is a view in vertical cross-section of the container showing the path for movement of the cylindrical elements and the contained shells.

Each cylindrical element 14 has an upwardly disposed projection 18 which is freely disposed through a slot at 19 of the cylindrical element 14 immediately thereabove and has an integral lateral detent which retains said elements 14 in a chain when manually set in motion, as illustrated in FIGS. 4 and 5. Each slot at 19 is wider than the projection 18 and the detent 18 to permit relative turning movement of the elements 14.

Having thus described the invention, what is claimed and desired to be secured by Letters Patent of the United States, is:

1. A shell dispenser and container for trap and skeet shells, including tubular elements for storing and conveying a plurality of shells, said container having a top and top side integral aperture for manual removal of shells for gun loading, and means for manual movement of the tubular elements.

2. A device as in claim 1, and hook means fixed in the forward portion of each tubular element protruding therefrom, to engage in a slot in the tubular element frontally thereof to protrude laterally to retain engagement of the tubular elements containing the shells.

* * * * *